US007404752B1

(12) United States Patent
Karon

(10) Patent No.: US 7,404,752 B1
(45) Date of Patent: Jul. 29, 2008

(54) ADHESIVE ATTACHMENT TO BRASSIERE

(76) Inventor: Hylton Karon, Unit 1 525 Denison Street, Markham, Ontario (CA) L3R 1B8

( * ) Notice: Subject to any disclaimer, the term of this patent is extended or adjusted under 35 U.S.C. 154(b) by 0 days.

(21) Appl. No.: 11/807,320

(22) Filed: May 29, 2007

(51) Int. Cl.
*A41C 3/10* (2006.01)
*A41C 3/12* (2006.01)

(52) U.S. Cl. ..... 450/81; 450/57; 450/1; 450/37; 2/53

(58) Field of Classification Search ..... 450/1, 450/81, 54–57, 37, 59, 53, 60, 61, 67, 80, 450/14–16; 2/267, 268, 53, 56, 453, 463, 2/46, 50, 60, 1, 57; 604/289, 290, 358, 363–368, 604/385.07; 602/41–46, 48, 52, 54, 56
See application file for complete search history.

(56) References Cited

U.S. PATENT DOCUMENTS 2,508,855 A * 5/1950 Brown ..... 428/43
2,869,553 A * 1/1959 D'or ..... 450/81
4,333,471 A * 6/1982 Nakai ..... 450/81
5,716,255 A * 2/1998 Abercrombie et al. ..... 450/60
5,980,359 A * 11/1999 Brown ..... 450/57
6,203,399 B1 * 3/2001 Hackney ..... 450/1
6,264,530 B1 * 7/2001 Cosentino ..... 450/57
6,341,377 B1 * 1/2002 Faries et al. ..... 2/53
6,761,614 B2 * 7/2004 Pinna ..... 450/81
7,229,335 B2 * 6/2007 Davis ..... 450/81

* cited by examiner

*Primary Examiner*—Gloria Hale

(57) ABSTRACT

An attachment for a brassiere is disclosed. The attachment comprises an elongated segment of fabric having an upper portion and a lower portion. The attachment further comprises an adhesive disposed on the upper portion of a proximal side of the segment of fabric so as to adhere to an interior surface of a brassiere cup, wherein the lower portion of the segment of fabric extends below the brassiere cup. The attachment may comprise an absorbent material and may aid in preventing pinching of the skin by the lower portion of the brassiere cups.

19 Claims, 4 Drawing Sheets

ADHESIVE ATTACHMENT TO BRASSIERE

CROSS-REFERENCE TO RELATED APPLICATIONS

Not Applicable

STATEMENT REGARDING FEDERALLY SPONSORED RESEARCH OR DEVELOPMENT

Not Applicable

INCORPORATION BY REFERENCE OF MATERIAL SUBMITTED ON A COMPACT DISC

Not Applicable

FIELD OF THE INVENTION

This invention relates to the field of brassieres and more particularly to improved features for brassieres for larger breasted women.

BACKGROUND OF THE INVENTION

The female breasts have very little internal support, being composed largely of adipose tissue or fat. It is believed that the primary anatomical support for the breast is provided by the Cooper's ligaments, with the skin covering the breasts offering some additional support. However, this anatomical support is usually insufficient to hold the breasts up (especially in older women), and to prevent movement of the breasts, which can cause pain and discomfort. Thus, the primary reason for wearing a brassiere or similar foundation garment is to provide external support for the breasts, increasing comfort and mobility. Brassieres are also believed by some to help preserve the youthful shape of breasts (which naturally sag as women grow older).

A brassiere consists of a pair cups for the breasts, a center panel, and a band running around the body under the bust. Unless a brassiere is a strapless brassiere, it will also include a shoulder strap at each side. A brassiere is typically made of a fabric such as cotton or lace, with the cups for the breasts given shape by underwires or plastic reinforcements. The brassiere is usually fastened with a hook fastener on the band, typically at the back, but in some embodiments the fastener is situated at the front, in between the cups.

One problem with brassieres is the pinching that occurs when the lower portion of a brassiere cup rolls underneath and pinches the skin of the lower part of the breast. This is particularly a problem for women with large breasts and/or women that are overweight or obese. The outer surface of a thin woman's breast is typically supple or taut. A woman with larger breasts and/or a woman that is overweight or obese will have larger amounts of subcutaneous fat in the breast area, thereby making the skin around the breasts much more inelastic and pliable. The breasts of these women often bulge or spill out of the bottom of the breast cup, thereby applying a force on the outer edges of the bottom portion of the breast cups, wherein the force is directed inwards. This phenomenon often results in the inward folding or rolling of the outer edges of the bottom portion of the breast cups, resulting in the pinching of the soft and sensitive skin of the breasts. This can be painful and highly annoying to the wearer of the brassiere.

Another problem experienced by women with large breasts and/or women that are overweight or obese is sweating due to the brassiere. Since these women possess higher levels of subcutaneous fat, which has a heat-insulating effect, and their physical conditions are usually reflective of sedentary lifestyles, which result in easy agitation due to physical exertion, these women often sweat easily. This is compounded by the wearing of a brassiere which provides more heat insulation and restricts movement. This can result in embarrassing sweat stains on the clothing or brassiere, as well as discomfort for the wearer.

Therefore, a need exists to overcome the problems with the prior art as discussed above, and particularly for an improved brassiere that relieves discomfort for larger breasted women.

SUMMARY OF THE INVENTION

Briefly, according to an embodiment of the present invention, an attachment for a brassiere is disclosed. The attachment comprises an elongated segment of fabric having an upper portion and a lower portion. The attachment further comprises an adhesive disposed on the upper portion of a proximal side of the segment of fabric so as to adhere to an interior surface of a brassiere cup, wherein the lower portion of the segment of fabric extends below the brassiere cup.

In another embodiment of the present invention, an apparatus for attachment to a brassiere is disclosed. The apparatus comprises a first elongated segment of fabric having an upper portion and a lower portion and including an adhesive disposed on the upper portion of a proximal side of the first segment of fabric so as to adhere to an interior surface of a first brassiere cup, wherein the lower portion of the segment of fabric extends below the first brassiere cup. The apparatus further comprises a second elongated segment of fabric having an upper portion and a lower portion and including an adhesive disposed on the upper portion of a proximal side of the second segment of fabric so as to adhere to an interior surface of a second brassiere cup, wherein the lower portion of the segment of fabric extends below the second brassiere cup.

In another embodiment of the present invention, a brassiere having an attachment is disclosed. The brassiere comprises a first breast cup connected to a second breast cup. The brassiere further comprises a first elongated segment of fabric having an upper portion and a lower portion and including an adhesive disposed on the upper portion of a proximal side of the first segment of fabric so as to adhere to an interior surface of the first breast cup, wherein the lower portion of the segment of fabric extends below the first breast cup. The brassiere further comprises second elongated segment of fabric having an upper portion and a lower portion and including an adhesive disposed on the upper portion of a proximal side of the second segment of fabric so as to adhere to an interior surface of the second breast cup, wherein the lower portion of the segment of fabric extends below the second breast cup.

The foregoing and other features and advantages of the present invention will be apparent from the following more particular description of the preferred embodiments of the invention, as illustrated in the accompanying drawings.

BRIEF DESCRIPTION OF THE DRAWINGS

The subject matter, which is regarded as the invention, is particularly pointed out and distinctly claimed in the claims at the conclusion of the specification. The foregoing and other features and also the advantages of the invention will be apparent from the following detailed description taken in conjunction with the accompanying drawings. Additionally, the left-most digit of a reference number identifies the drawing in which the reference number first appears.

DETAILED DESCRIPTION

Figure 1:
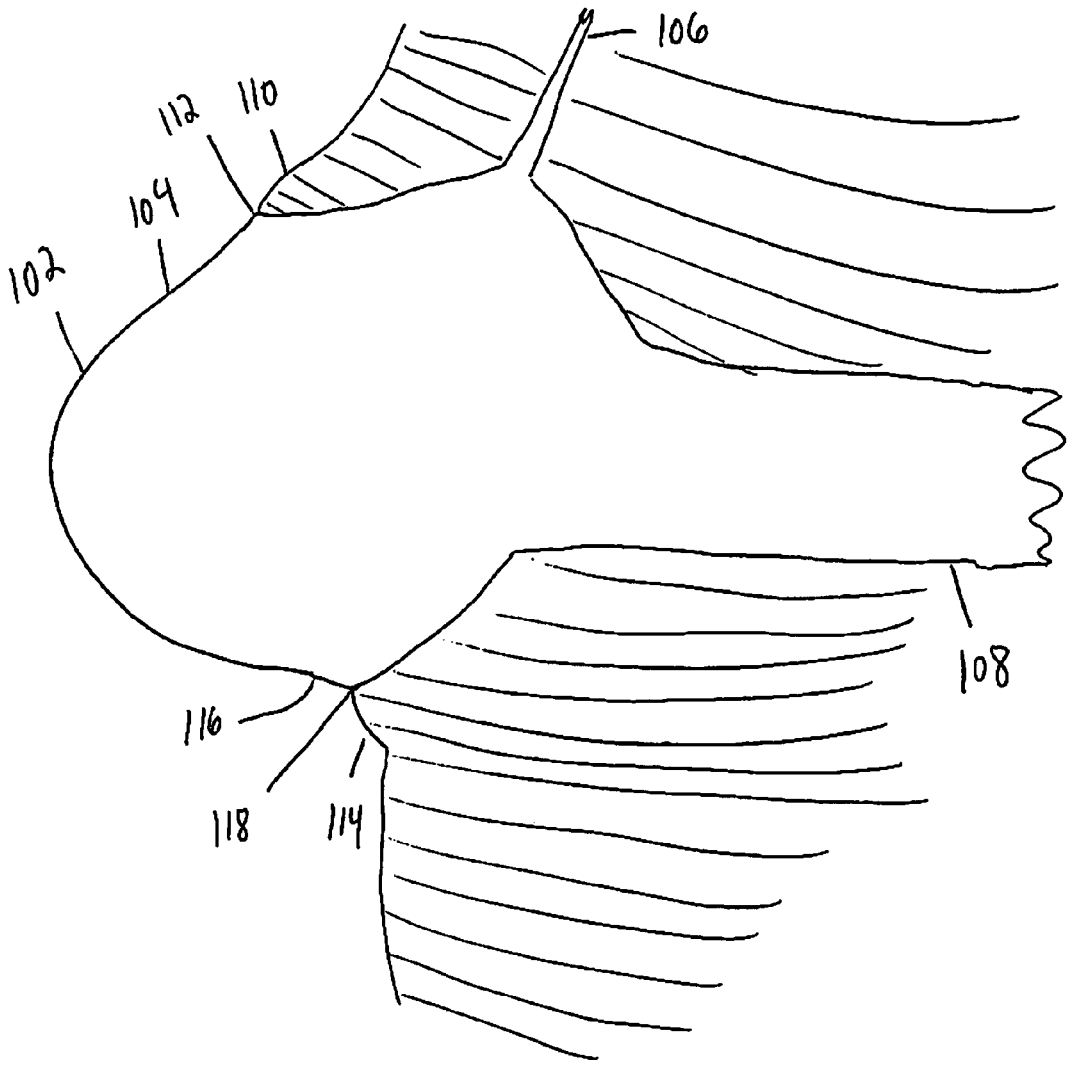
FIG. 1 is an illustration of a side view of a larger breasted woman wearing a conventional brassiere.

FIG. 1 is an illustration of a side view of a larger breasted woman wearing a conventional brassiere 102. The brassiere 102 comprises a breast cup 104, a shoulder strap 106 and a back strap 108. Note the bulging 110 of the top of the breast out of the top portion 112 of the breast cup 104. Also note the bulging 114 of the bottom of the breast out of the bottom portion 116 of the breast cup 104. This bulging 114 creates a force on the outer edges 118 of the bottom portion 116 of the breast cup 104, wherein the force is directed inwards. This results in the inward folding or rolling (not shown) of the outer edges 118 of the bottom portion 116 of the breast cup 104, shown in greater detail below.

Figure 2:
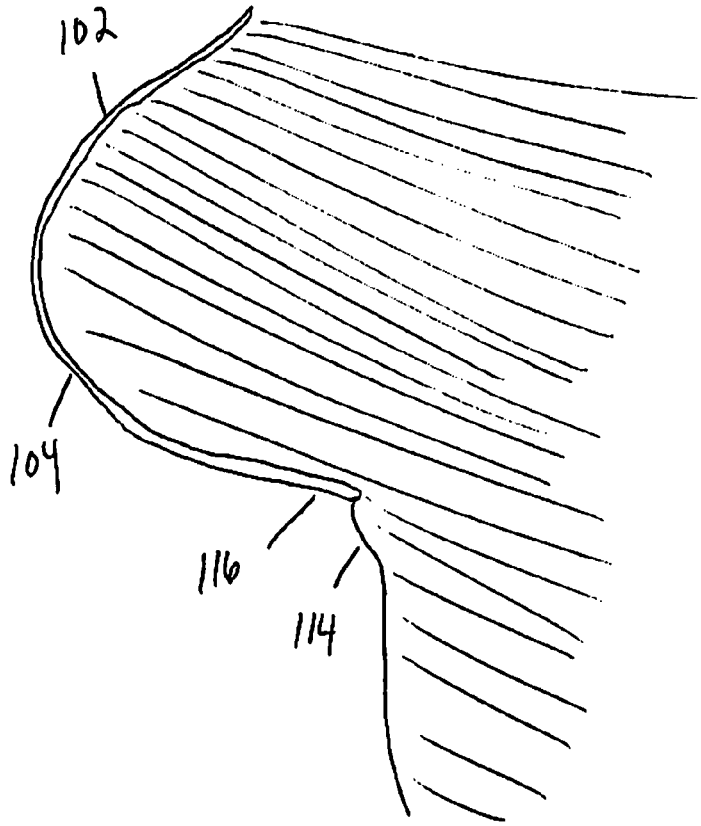
FIG. 2 is an illustration of a cross-sectional view of the larger breasted woman wearing a conventional brassiere of FIG. 1.
Figure 3:
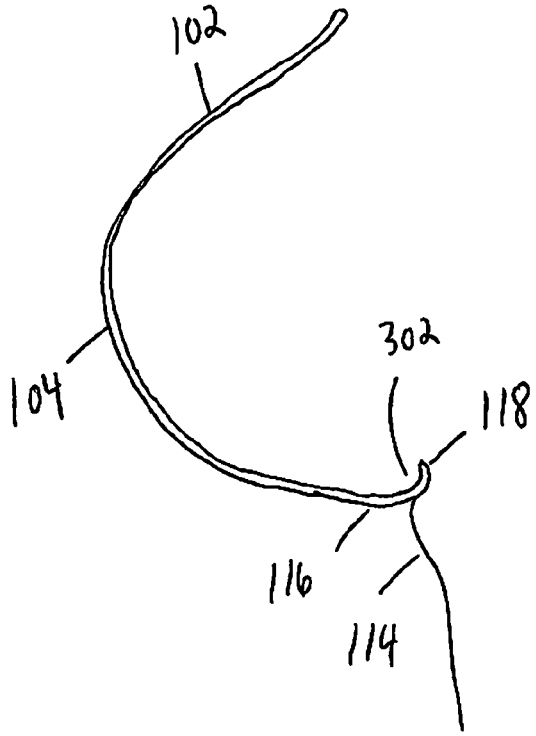
FIG. 3 is an illustration of a cross-sectional view of the larger breasted woman wearing a conventional brassiere of FIG. 1, further illustrating the rolling or folding effect.

FIG. 2 is an illustration of a cross-sectional view of the larger breasted woman wearing a conventional brassiere 102 of FIG. 1. Note the bulging 114 of the bottom of the breast out of the bottom portion 116 of the breast cup 104. FIG. 3 is an illustration of a cross-sectional view of the larger breasted woman wearing a conventional brassiere 102 of FIG. 1, further illustrating the rolling or folding effect. Note the bulging 114 of the bottom of the breast out of the bottom portion 116 of the breast cup 104. This bulging 114 results in the inward folding or rolling of the outer edges 118 of the bottom portion 116 of the breast cup 104. Note that a portion 302 of sensitive breast skin is trapped or pinched by the outer edges 118 of the bottom portion 116 of the breast cup 104.

Figure 4:
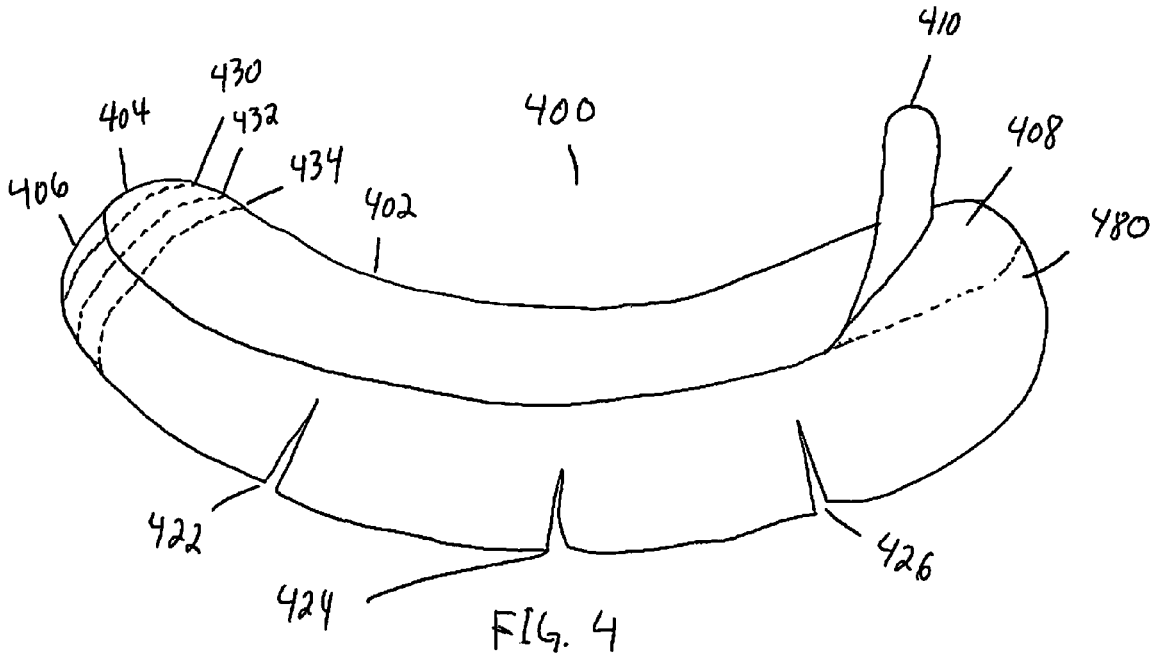
FIG. 4 is an illustration of a rear view of an adhesive attachment for a brassiere in accordance with one embodiment of the present invention.

FIG. 4 is a rear view of an adhesive attachment 400 for a brassiere in accordance with one embodiment of the present invention. The attachment 400 comprises a segment of fabric 402 having an elongated oval shape in a concave form. The attachment 400 includes a lower portion 406 and an upper portion 404 for adhering to a brassiere. The attachment 400 further includes a removable strip of paper 410 adhered to the upper portion 404 of the proximal side 480 (i.e., the side that contacts the brassiere) of attachment 400. The strip of paper 410 is removed before applying the attachment 400 to an interior surface of a brassiere cup. Note that when the upper portion 404 of attachment 400 is adhered to an interior surface of a brassiere cup, the lower portion 406 extends below the brassiere cup. This is shown in greater detail below.

The attachment 400 includes an adhesive 408 disposed on upper portion 404 of the proximal side 480 of attachment 400 for adhering to the inside surface of a breast cup. The adhesive 408 may be an acrylate copolymer or a solvent dispersion of cross-linked rubbers or acrylates. The adhesive 408 may further be a removable adhesive that allows the attachment 400 to be applied to a brassiere, removed and applied again multiple times.

The attachment 400 may be comprised of a combination of elastic and inelastic fabrics. The attachment 400 may further be comprised of any one of a woven material, a natural fiber material, a synthetic fiber material and a blended fiber material. The fabric of the attachment 400 may comprise an elastic fabric such as spandex or elastane, which is a synthetic fiber known for its elasticity. Spandex or elastane is a manufactured fiber in which the fiber-forming substance is a long chain synthetic polymer comprised of at least 85 percent of a segmented polyurethane. Spandex is spun from a block copolymer and its fibers exploit the high crystallinity and hardness of polyurethane segments, yet remain "rubbery" due to alternating segments of polyethylene glycol. The fabric of the attachment 400 may further comprise a synthetic blend fiber fabric exhibiting elastic characteristics. The fabric of the attachment 400 may further comprise a substantially inelastic fabric such as woven or non-woven fabric comprising, cotton, cotton blend, synthetic, or synthetic blend of material. Additionally, the fabric of the attachment 400 may be absorbent.

FIG. 4 further shows a plurality of slits 422, 424, 426 located in the lower portion 406 of the segment of fabric 402, wherein each slit is perpendicular to the elongated segment of fabric 402, so as to allow the lower portion 406 of the segment of fabric 402 to flare outwards when the attachment 400 is applied to an interior surface of a brassiere cup. The plurality of slits 422, 424, 426 may be distributed evenly along the length of the lower portion 406 of the segment of fabric 402.

FIG. 4 additionally shows vertical indicators 430, 432 and 434 located on a left side of the attachment 400. Additional vertical indicators (not shown) may be located on a right side of the attachment 400. In the event the attachment 400 is too long or irregularly shaped and thereby cannot fit into a particular breast cup, the attachment 400 can be ripped or cut along the vertical indicators 430, 432 and 434. The purpose of each vertical indicator 430, 432 and 434 is to indicate where the attachment 400 may be trimmed so as to fit within a breast cup. Each vertical indicator is shaped such that the general form of the tip of the attachment 400 is maintained, albeit shorter in length.

A vertical indicator 430, 432 and 434 can take a variety of forms. For example, a vertical indicator can be a perforation comprising a series of holes or orifices that penetrate all or a portion of the fabric or fabrics that comprise the attachment 400. A perforation may allow a user to rip the attachment 400 along the perforation using her hands alone. A vertical indicator may further be a depressed stamp that causes a depression or an indentation in the fabric or fabrics that comprise the attachment 400. A vertical indicator may further be a stitching, a colored mark or a crease that may allow a user to cut a slice along the vertical indicator using a tool such as a scissor.

Figure 5:
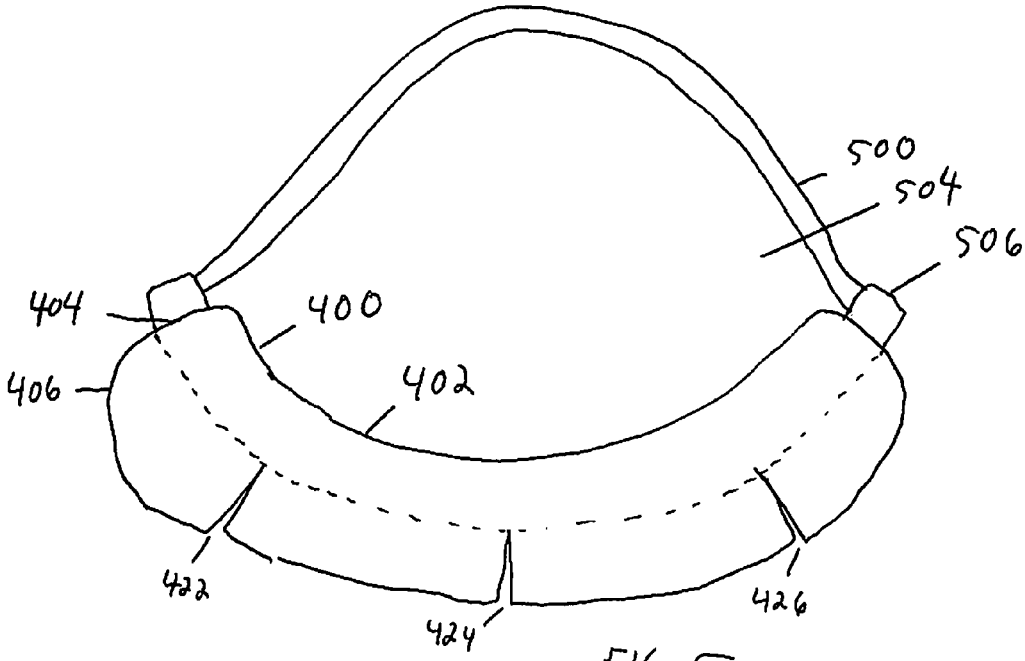
FIG. 5 is an illustration of a rear view of a brassiere cup having the attachment attached thereto, in accordance with one embodiment of the present invention.

FIG. 5 is an illustration of a rear view of a brassiere cup 500 having the attachment 400 attached thereto, in accordance with one embodiment of the present invention. The distal side 502 of the attachment 400 is shown wherein the proximal side 480 (not shown) is facing the brassiere cup 500. The proximal side of upper portion 404 of attachment 400 is adhered, using adhesive 408, to the lower portion 506 of the interior surface 504 of brassiere cup 500. Note the lower portion 406 of attachment 400 extending below the brassiere cup 500. Also note the slits 422, 424, 426 located in the lower portion 406 of the segment of fabric 402, wherein each slit allows the lower portion 406 of the segment of fabric 402 to flare outwards when the attachment 400 is applied to the brassiere cup 500.

The attachment 400 contacts the wearer's skin and provides comfort due to its soft, absorbent nature.

Figure 6:
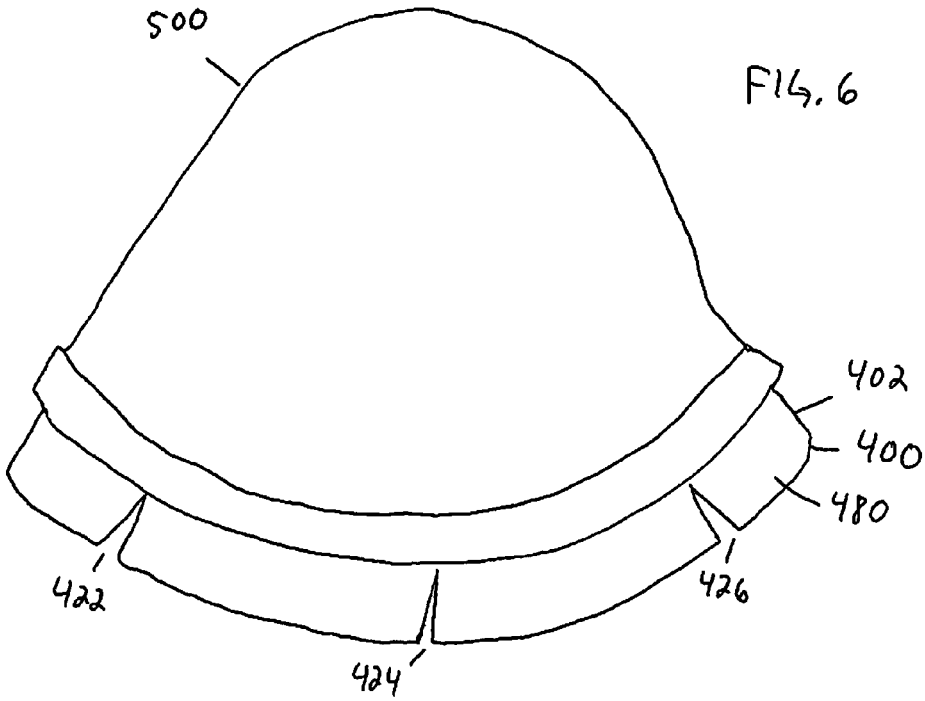
FIG. 6 is an illustration of a frontal view of a brassiere cup having the attachment attached thereto, in accordance with one embodiment of the present invention.

FIG. 6 is an illustration of a frontal view of the brassiere cup 500 having the attachment 400 attached thereto, in accordance with one embodiment of the present invention. The proximal side 480 of the attachment 400 is shown facing the interior surface of the brassiere cup 500. The proximal side 480 of upper portion 404 (not shown) of attachment 400 is adhered to the lower portion 506 of the interior surface 504 of brassiere cup 500. Note the lower portion 406 of attachment 400 extending below the brassiere cup 500. Also note the slits 422, 424, 426 allowing the lower portion 406 of the segment of fabric 402 to flare outwards when the attachment 400 is applied to the brassiere cup 500. Since the attachment 400 is absorbent, the placement of the attachment 400 against the wearer's skin allows for absorbing of sweat or other liquids and reducing or eliminating embarrassing stains on the wearer's clothing or brassiere.

Figure 7:
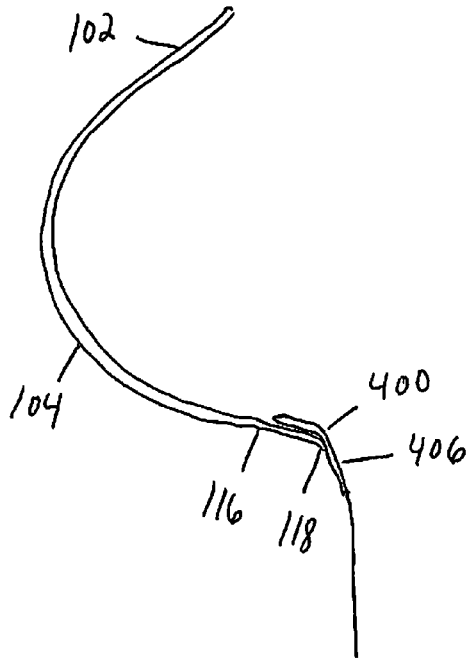
FIG. 7 is an illustration of a cross-sectional view of a larger breasted woman wearing a conventional brassiere having the attachment attached thereto, in accordance with one embodiment of the present invention.

FIG. 7 is an illustration of a cross-sectional view of a larger breasted woman wearing a conventional brassiere 102 having the attachment 400 attached thereto, in accordance with one embodiment of the present invention. Note the lower portion 406 of attachment 400 extending below the brassiere cup 104. The attachment 400 provides thickness and resistibility to bending to the outer edges 118 of the bottom portion 116 of the breast cup 104, so as to prevent inward folding or rolling of the outer edges 118 of the bottom portion 116 of the breast cup 104, thereby eliminating the pinching of sensitive breast skin, as illustrated in FIG. 3. The attachment 400 contacts the wearer's skin and prevents the outer edges 118 of the bottom portion 116 of the breast cup 104 from digging into the wearer's skin. Further, the wearer is provided more comfort while wearing the brassier since the attachment 400 is absorbent and soft.

Although specific embodiments of the invention have been disclosed, those having ordinary skill in the art will understand that changes can be made to the specific embodiments without departing from the spirit and scope of the invention. The scope of the invention is not to be restricted, therefore, to the specific embodiments. Furthermore, it is intended that the appended claims cover any and all such applications, modifications, and embodiments within the scope of the present invention.

I claim:

1. An attachment shield for a brassiere having a breast cup, comprising:

an elongated segment of fabric having an upper portion, a lower portion, and a proximal side that contacts said cup; and an adhesive disposed on the upper portion of said proximal side of the segment of fabric so as to adhere to an interior surface of a brassiere cup, wherein the lower portion of the segment of fabric extends below the bottom of the brassiere cup, said shield further comprising a plurality of slits located in the lower portion of the segment of fabric, wherein each slit is substantially perpendicular to the elongated segment of fabric so as to allow the lower portion of the segment of fabric to flare outwards when the shield is applied to an interior surface of a brassiere cup.

2. The attachment shield of claim 1, wherein the plurality of slits comprises three slits distributed evenly along a length of the lower portion of the segment of fabric.

3. The attachment shield of claim 1, further comprising a removable strip of paper covering the adhesive, wherein the strip of paper is removed before applying the shield to an interior surface of a brassiere cup.

4. The attachment shield of claim 1, wherein the segment of fabric is comprised of an absorbent material.

5. The attachment shield of claim 1, wherein the segment of fabric is comprised of any one of a woven material, a natural fiber material, a synthetic fiber material and a blended fiber material.

6. The attachment shield of claim 1, wherein the segment of fabric comprises a generally flat elongated oval shape having an upper concave edge and a lower convex edge.

7. The attachment shield of claim 1, further comprising at least one vertical indicator located along the length of the segment of fabric, wherein each vertical indicator indicates where the shield may be trimmed.

8. The attachment shield of claim 7, wherein the at least one vertical indicator comprises any one of a perforation, depressed stamp, a stitching, a colored mark and a crease.

9. An apparatus for attachment to a brassiere, comprising:

a first elongated segment of fabric having an upper portion, a lower portion and a proximal side that contacts said brassiere and including an adhesive disposed on the upper portion of said proximal side of the first segment of fabric so as to adhere to an interior surface of a first brassiere cup, wherein the lower portion of the segment of fabric extends below the bottom of the first brassiere cup; and a second elongated segment of fabric having an upper portion, a lower portion, and a proximal side that contacts said brassiere and including an adhesive disposed on the upper portion of said proximal side of the second segment of fabric so as to adhere to an interior surface of a second brassiere cup, wherein the lower portion of the segment of fabric extends below the bottom of the second brassiere cup.

10. The apparatus of claim 9, further comprising a plurality of slits located in the lower portion of the first segment of fabric, wherein each slit is perpendicular to the first segment of fabric, so as to allow the lower portion of the first segment of fabric to flare outwards when the first segment of fabric is applied to an interior surface of the first brassiere cup.

11. The apparatus of claim 10, further comprising a plurality of slits located in the lower portion of the second segment of fabric, wherein each slit is perpendicular to the second segment of fabric, so as to allow the lower portion of the second segment of fabric to flare outwards when the second segment of fabric is applied to an interior surface of the second brassiere cup.

12. The apparatus of claim 11, further comprising a removable strip of paper covering the adhesive on the first and second segments of fabric, wherein the strip of paper is removed before applying any segment to a brassiere.

13. The apparatus of claim 11, wherein the first and second segments of fabric are comprised of any one of a woven material, a natural fiber material, a synthetic fiber material and a blended fiber material.

14. The apparatus of claim 11, wherein the first and second segments of fabric comprise a generally flat elongated oval shape having an upper concave edge and a lower convex edge.

15. A brassiere, comprising:

a first breast cup connected to a second breast cup;

a first elongated segment of fabric having an upper portion, a lower portion and a proximal side that contacts said brassiere and including an adhesive disposed on the upper portion of said proximal side of the first segment of fabric so as to adhere to an interior surface of the first brassiere cup, wherein the lower portion of the segment of fabric extends below the bottom of the first brassiere cup; and a second elongated segment of fabric having an upper portion, a lower portion, and a proximal side that contacts said brassiere and including an adhesive disposed on the upper portion of said proximal side of the second segment of fabric so as to adhere to an interior surface of the second brassiere cup, wherein the lower portion of the segment of fabric extends below the bottom of the second brassiere cup.

16. The brassiere of claim 15, further comprising a plurality of slits located in the lower portion of the first segment of fabric, wherein each slit is perpendicular to the first segment of fabric, so as to allow the lower portion of the first segment of fabric to flare outwards when the first segment of fabric is applied to the interior surface of the first breast cup.

17. The brassiere of claim 16, further comprising a plurality of slits located in the lower portion of the second segment of fabric, wherein each slit is perpendicular to the second segment of fabric, so as to allow the lower portion of the second segment of fabric to flare outwards when the second segment of fabric is applied to the interior surface of the second breast cup.

18. The brassiere of claim 17, wherein the first and second segments of fabric are comprised of any one of a woven material, a natural fiber material, a synthetic fiber material and a blended fiber material.

19. The brassiere of claim 18, wherein the adhesive on the first and second segments of fabric is re-usable.

* * * * *